US008347835B2

(12) United States Patent
Gallon et al.

(10) Patent No.: US 8,347,835 B2
(45) Date of Patent: Jan. 8, 2013

(54) ENGINE ASSEMBLY INCLUDING SECONDARY OIL PUMP AND PUMP MOUNTING STRUCTURE

(75) Inventors: Robert Jack Gallon, Northville, MI (US); David R. Staley, Flushing, MI (US)

(73) Assignee: GM Global Technology Operations LLC

( * ) Notice: Subject to any disclaimer, the term of this patent is extended or adjusted under 35 U.S.C. 154(b) by 721 days.

(21) Appl. No.: 12/605,668

(22) Filed: Oct. 26, 2009

(65) Prior Publication Data

US 2011/0094463 A1 Apr. 28, 2011

(51) Int. Cl.
*F01L 9/02* (2006.01)

(52) U.S. Cl. ..... 123/90.12; 123/90.33; 123/90.17; 123/196 R; 123/196 M

(58) Field of Classification Search ..... 123/90.1, 123/90.12, 90.15, 90.17, 90.33, 90.34, 90.38, 123/196 R, 196 M; 384/428, 432, 433, 434, 384/440

See application file for complete search history.

(56) References Cited

U.S. PATENT DOCUMENTS

| | | | | |
|---|---|---|---|---|
| 6,640,757 | B2 * | 11/2003 | Uchida | 123/90.12 |
| 7,395,802 | B2 * | 7/2008 | Riley et al. | 123/196 R |
| 7,536,987 | B2 * | 5/2009 | Yoshijima et al. | 123/90.33 |
| 7,556,001 | B2 * | 7/2009 | Kim et al. | 123/90.17 |
| 7,942,121 | B2 * | 5/2011 | Lunsford et al. | 123/90.34 |
| 8,051,820 | B2 * | 11/2011 | Shoji | 123/90.33 |
| 8,171,903 | B2 * | 5/2012 | Kim | 123/90.17 |

* cited by examiner

*Primary Examiner* — Thomas Denion
*Assistant Examiner* — Daniel Bernstein
(74) *Attorney, Agent, or Firm* — Harness, Dickey & Pierce, P.L.C.

(57) ABSTRACT

A cam bearing cap may include a first bearing cap region, a pump mounting region, an oil inlet, and an oil outlet. The first bearing cap region may extend over and secure a first camshaft to an engine assembly. The pump mounting region may extend from the first bearing cap region and may have a secondary oil pump mounted thereto. The oil inlet may extend through the pump mounting region and may provide communication between the secondary oil pump and an oil supply. The oil outlet may extend through the pump mounting region and may provide communication between the secondary oil pump and a hydraulically actuated engine component.

20 Claims, 5 Drawing Sheets

ENGINE ASSEMBLY INCLUDING SECONDARY OIL PUMP AND PUMP MOUNTING STRUCTURE

FIELD

The present disclosure relates to internal combustion engines, and more specifically to secondary oil pumps and pump mounting structures for internal combustion engines.

BACKGROUND

This section provides background information related to the present disclosure which is not necessarily prior art.

Engine assemblies may include hydraulically actuated components such as cam phasers that are operated by application of a pressurized fluid such as oil. During some operating conditions the oil pressure provided by the primary oil pump may be below a pressure required for a desired response of the hydraulically actuated component. As a result, a secondary oil pump may be incorporated into the engine assembly. However, packaging the secondary oil pump in the engine assembly may be difficult due to various lines required to transport oil to and from the secondary oil pump.

SUMMARY

An engine assembly may include a cylinder head, a first camshaft rotationally supported on the cylinder head, a cam bearing cap, a hydraulically actuated engine component, and a secondary oil pump. The cylinder head may include first and second oil supply passages. The first oil supply passage may be in communication with pressurized oil from a primary oil pump. The cam bearing cap may include a first bearing cap region extending over the first camshaft and a pump mounting region extending from the first bearing cap region and defining an oil inlet and an oil outlet. The oil inlet may be in communication with the first oil supply passage and the oil outlet may be in communication with the second oil supply passage. The hydraulically actuated engine component may be in communication with the second oil supply passage. The secondary oil pump may be mounted to the pump mounting region and may receive pressurized oil from the primary oil pump through the oil inlet and may pump the oil through the oil outlet to the hydraulically actuated engine component via the second oil supply passage.

In another arrangement, an engine assembly may include a cylinder head, first and second camshafts rotationally supported on the cylinder head, a cam bearing cap, a cam phaser, and a secondary oil pump. The cylinder head may include first and second oil supply passages. The first oil supply passage may be in communication with pressurized oil from a primary oil pump. The cam bearing cap may include a first bearing cap region extending over the first camshaft, a second bearing cap region extending over the second camshaft, and a pump mounting region extending between the first and second bearing cap regions. The pump mounting region may define an oil inlet and an oil outlet. The oil inlet may be in direct communication with the first oil supply passage and the oil outlet may be in direct communication with the second oil supply passage. The cam phaser may be in communication with the second oil supply passage. The secondary oil pump may be mounted to the pump mounting region and may be in direct communication with the oil inlet and the oil outlet to provide further pressurized oil to the cam phaser via the second oil supply passage.

A cam bearing cap may include a first bearing cap region, a pump mounting region, an oil inlet, and an oil outlet. The first bearing cap region may extend over and secure a first camshaft to an engine assembly. The pump mounting region may extend from the first bearing cap region and may have a secondary oil pump mounted thereto. The oil inlet may extend through the pump mounting region and may provide communication between the secondary oil pump and an oil supply. The oil outlet may extend through the pump mounting region and may provide communication between the secondary oil pump and a hydraulically actuated engine component.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
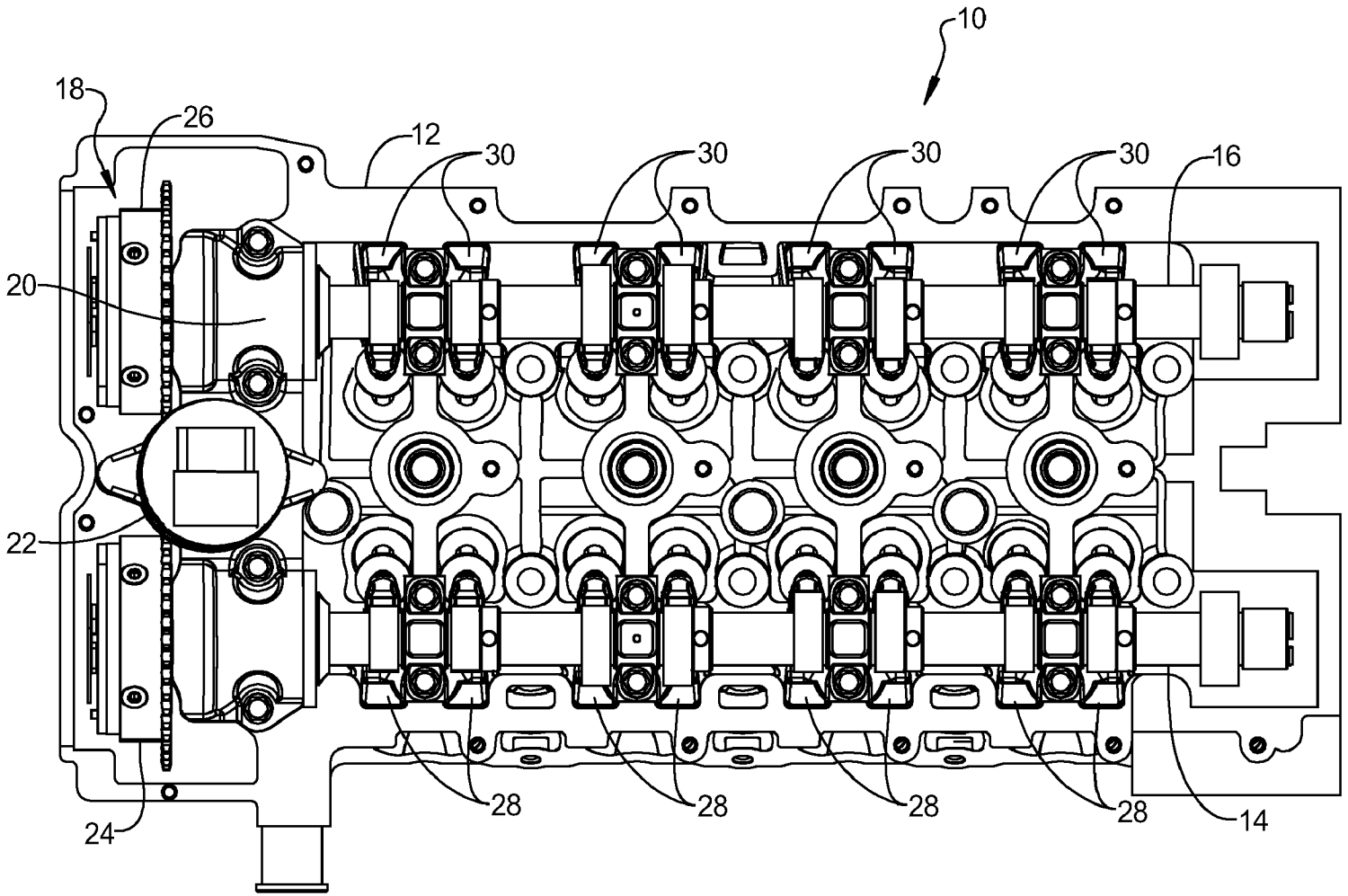
FIG. 1 is a plan view of an engine assembly according to the present disclosure.
Figure 2:
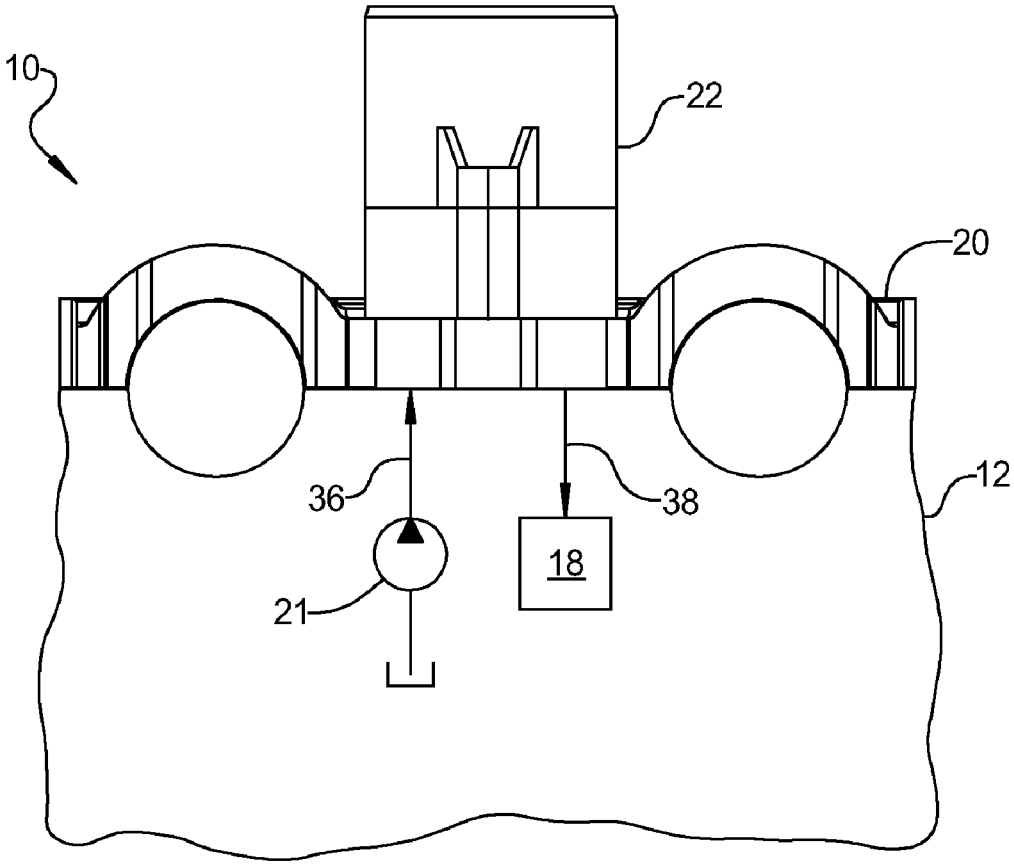
FIG. 2 is a schematic illustration of the engine assembly of FIG. 1.

Referring now to FIGS. 1 and 2, an exemplary engine assembly 10 is schematically illustrated. The engine assembly 10 may include a cylinder head 12, intake and exhaust camshafts 14, 16, a hydraulically actuated engine component assembly 18, a cam bearing cap 20, a primary oil pump 21, and a secondary oil pump 22. The hydraulically actuated engine component assembly 18 may include intake and exhaust cam phasers 24, 26 and/or intake and exhaust valve lift assemblies 28, 30.

By way of non-limiting example, the intake and exhaust cam phasers 24, 26 may each include a hydraulically actuated cam phaser having a rotor and a stator. The stator may be rotationally driven by an engine crankshaft. The rotor may be located within the stator and may include radially extending vanes cooperating with the stator to form hydraulic chambers in communication with pressurized oil from the secondary oil pump 22. The intake and exhaust valve lift assemblies 28, 30 may include multi-step rocker arms or lifters that selectively vary the lift duration of intake and exhaust valves. The secondary oil pump 22 may include an electric oil pump.

As seen in FIG. 2, the cylinder head 12 may define first and second oil supply passages 36, 38. The first oil supply passage 36 may be in communication with the primary oil pump 21 and the secondary oil pump 22. The second oil supply passage 38 may be in communication with the secondary oil pump 22 and the hydraulically actuated engine component assembly 18.

Figure 3:
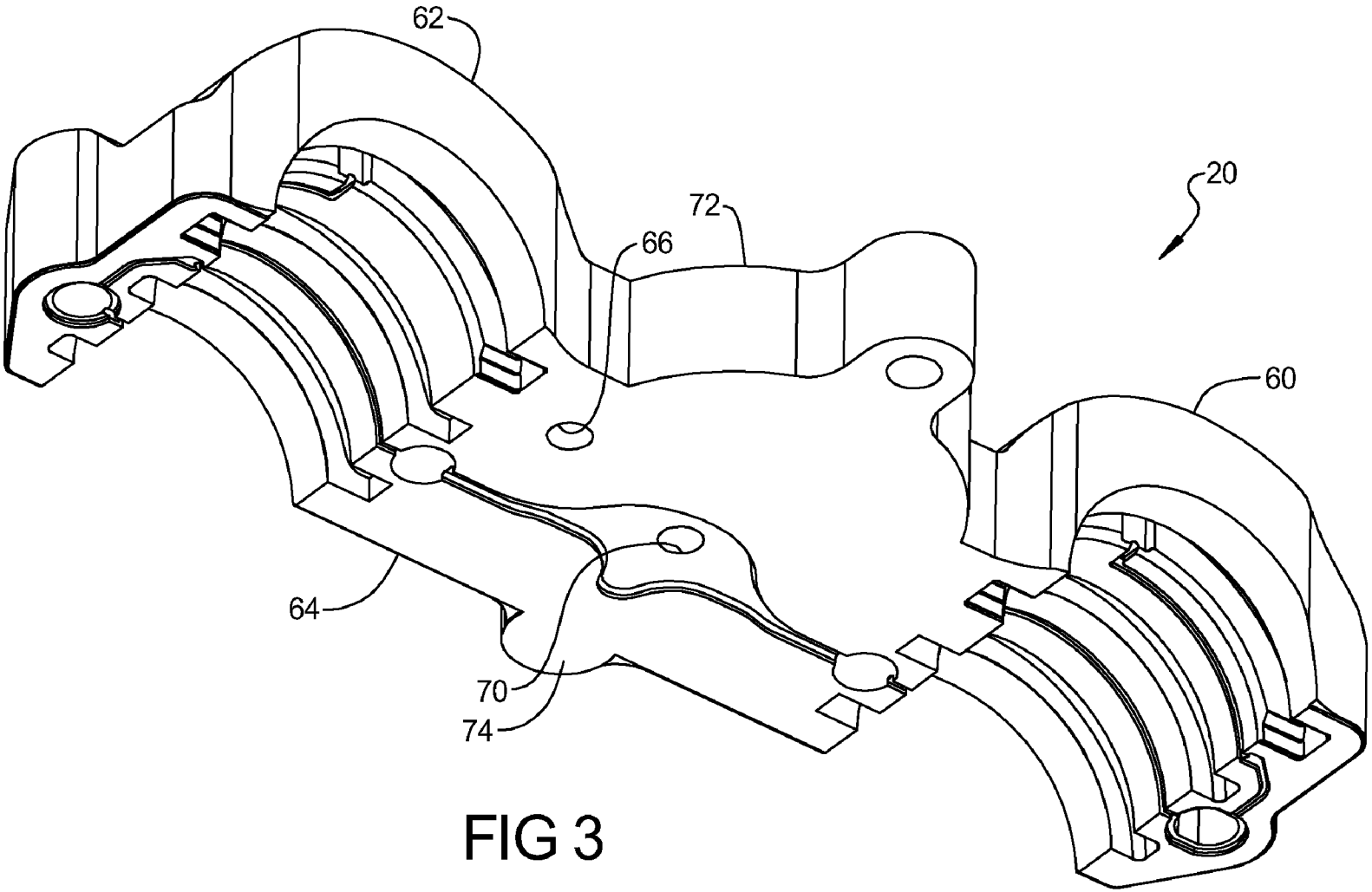
FIG. 3 is a perspective view of the cam bearing cap of FIG. 2.

With additional reference to FIG. 3, the cam bearing cap 20 may be formed as a monolithic member and may include first and second bearing cap regions 60, 62 and a bridge region 64 extending therebetween. The bridge region 64 may form a pump mounting region and may include a pump inlet passage 66 and a pump outlet passage 70. The bridge region 64 may include a pump mount surface 72 and an engine mount surface 74. The pump mount surface 72 may form the pump mounting region having the secondary oil pump 22 fixed thereto. The pump inlet passage 66 and pump outlet passage 70 may pass through the pump and engine mount surfaces 72, 74.

The engine mount surface 74 of the bridge region 64 may extend above, and more specifically may abut the upper surface of the cylinder head 12. The pump inlet passage 66 may be aligned with the first oil supply passage 36 and the pump outlet passage 68 may be aligned with the second oil supply passage 38. The primary oil pump 21 may provide oil to the secondary oil pump 22 directly through the pump inlet passage 66 and the secondary oil pump 22 may further pressurize the oil from the primary oil pump 21. The secondary oil pump 22 may provide the oil at increased pressure to the second oil supply passage 38 directly through the pump outlet passage 68.

Figure 4:
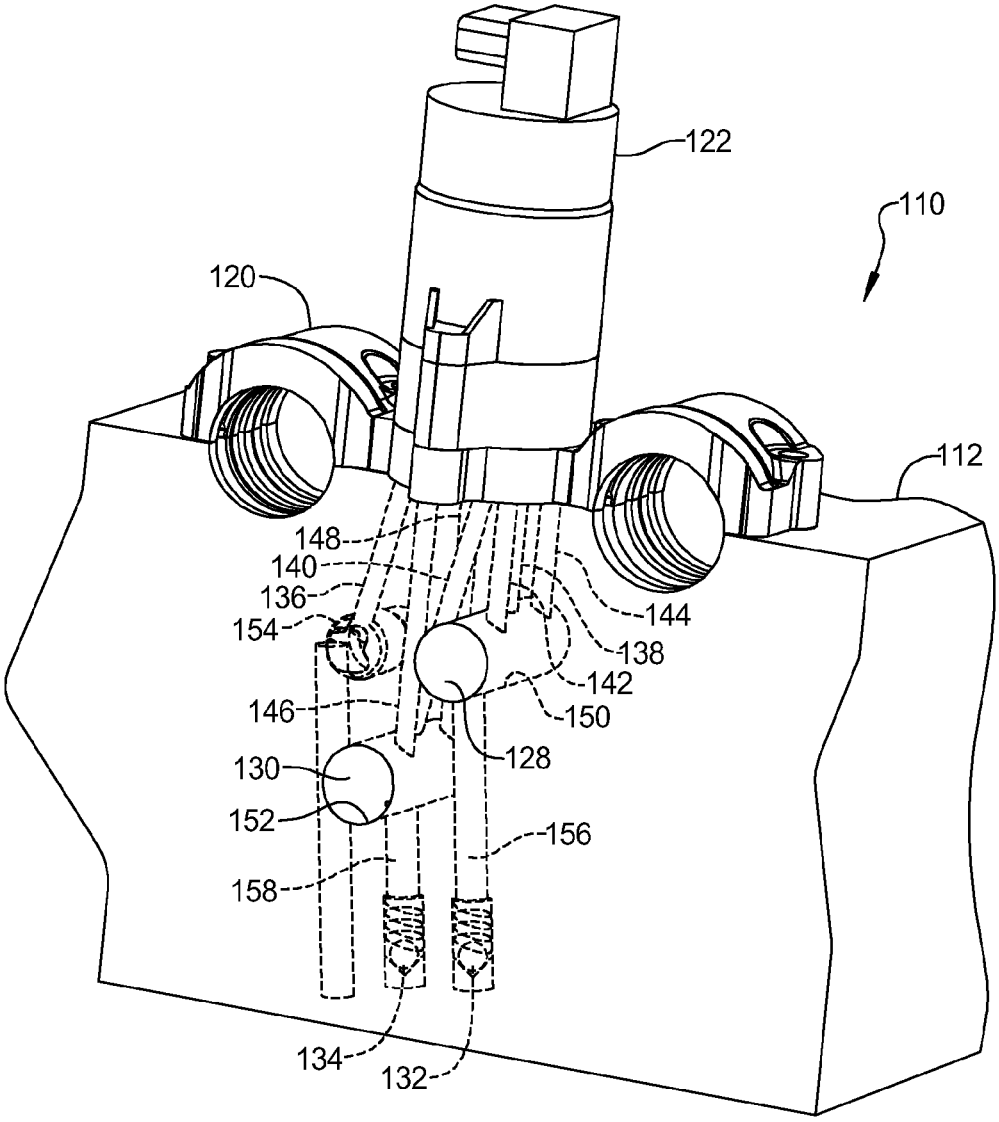
FIG. 4 is a fragmentary perspective view of an alternate engine assembly according to the present disclosure.
Figure 5:
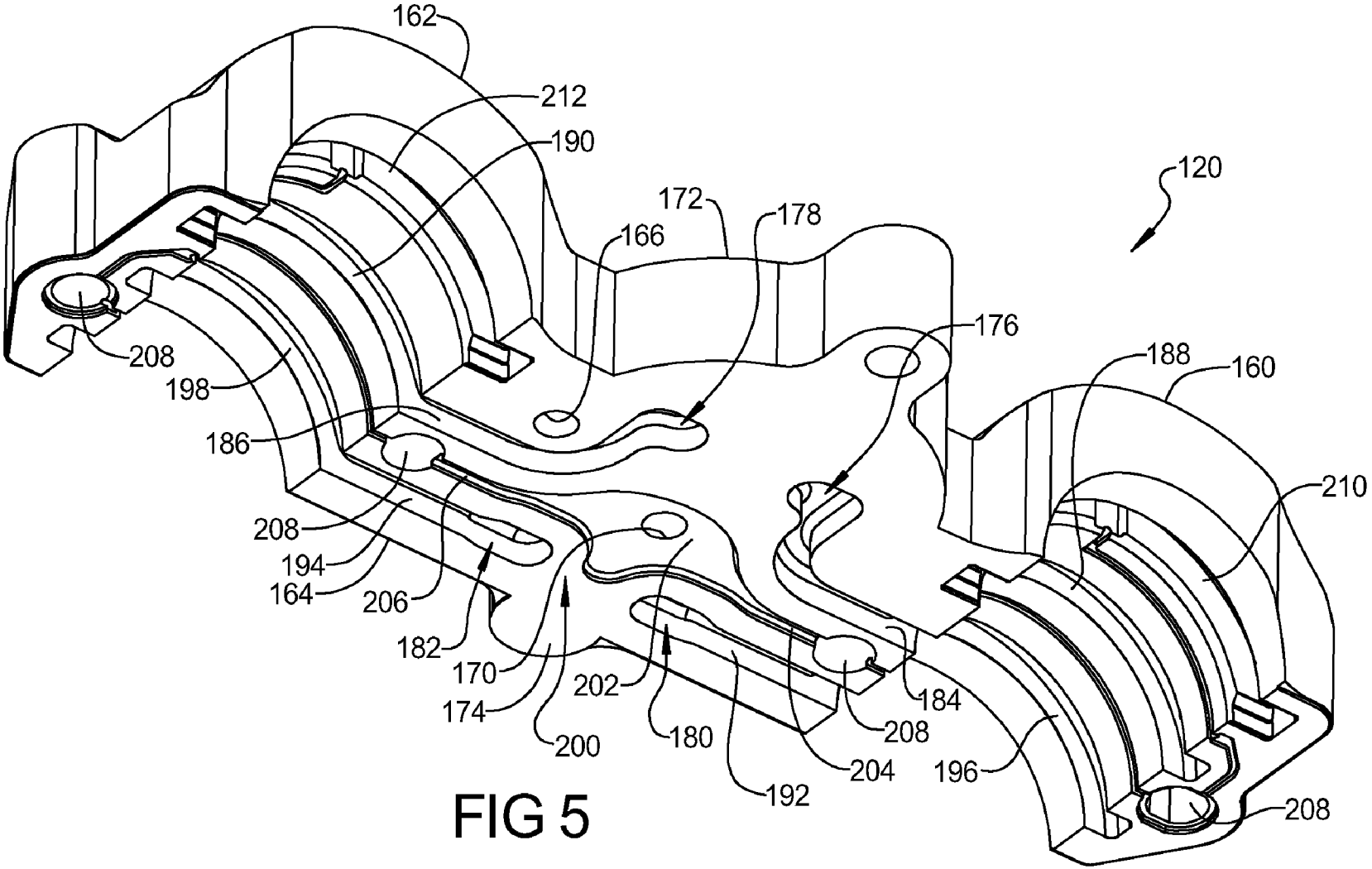
FIG. 5 is a perspective view of the cam bearing cap of FIG. 4.

In another non-limiting example shown in FIGS. 4 and 5, the hydraulically actuated engine component assembly 118 may include the intake and exhaust cam phasers 24, 26 (seen in FIG. 1), oil control valves (OCV) 128, 130, and check valves 132, 134. As seen in FIG. 1, the intake cam phaser 24 may be coupled to the intake camshaft 14 and the exhaust cam phaser 26 may be coupled to the exhaust camshaft 16.

As seen in FIG. 4, in the alternate arrangement the cylinder head 112 may define first, second and third oil supply passages 136, 138, 140, and first, second, third and fourth cam phaser feed passages 142, 144, 146, 148. Each of the first, second and third oil supply passages 136, 138, 140, and first, second, third and fourth cam phaser feed passages 142, 144, 146, 148 may intersect an upper surface of the cylinder head 112. The cylinder head 112 may additionally define first and second bores 150, 152 housing OCVs 128, 130, a hydraulic lash adjuster feed passage 154 and first and second auxiliary oil supply passages 156, 158.

The first oil supply passage 136 may form a secondary oil pump supply passage and may intersect the hydraulic lash adjuster feed passage 154 to provide oil from the primary oil pump (not shown) to the secondary oil pump 122. The second oil supply passage 138 and first and second cam phaser feed passages 142, 144 may intersect the first bore 150 and may be in communication with the OCV 128. Similarly, the third oil supply passage 140 and third and fourth cam phaser feed passages 146, 148 may intersect the second bore 152 and may be in communication with the OCV 130. Additionally, the first auxiliary oil supply passage 156 may intersect the first bore 150 and the second auxiliary oil supply passage 158 may intersect the second bore 152. The check valves 132, 134 may be located in the first and second auxiliary oil supply passages 156, 158, respectively, to prevent oil flow through the first and second auxiliary oil supply passages 156, 158 from the secondary oil pump 122.

With reference to FIG. 5, the cam bearing cap 120 may be formed as a monolithic member and may include first and second bearing cap regions 160, 162 and a bridge region 164 extending therebetween. The bridge region 164 may form a pump mounting region and may include a pump inlet passage 166 and a pump outlet passage 170. The bridge region 164 may include a pump mount surface 172 and an engine mount surface 174. The pump mount surface 172 may form the pump mounting region having the secondary oil pump 122 fixed thereto. The pump inlet passage 166 and pump outlet passage 170 may pass through the pump and engine mount surfaces 172, 174. The engine mount surface 174 may include first and second advance passages 176, 178 and first and second retard passages 180, 182.

The first and second advance passages 176, 178 may each include a first recess 184, 186 in the engine mount surface 174 and a second recess 188, 190 forming grooves in the first and second bearing cap regions 160, 162. Similarly, the first and second retard passages 180, 182 may each include a first recess 192, 194 in the engine mount surface 174 and a second recess 196, 198 forming grooves in the first and second bearing cap regions 160, 162. The second recess 188, 196 may be axially spaced from one another and the second recesses 190, 198 may be axially spaced from one another. The engine mount surface 174 of the bridge region 164 may extend above, and more specifically may abut the upper surface of the cylinder head 112.

The pump inlet passage 166 may be aligned with the first oil supply passage 136 and the pump outlet passage 170 may be aligned with the second and third oil supply passages 138, 140. The first cam phaser feed passage 142 may be aligned with the first advance passage 176, the third cam phaser feed passage 146 may be aligned with the second advance passage 178, the second cam phaser feed passage 144 may be aligned with the first retard passage 180, and the fourth cam phaser feed passage 148 may be aligned with the second retard passage 182. The pump inlet passage 166 may be in direct communication with the first oil supply passage 136 and the pump outlet passage 170 may be in direct communication with the second and third oil supply passages 138, 140, respectively.

The secondary oil pump 122 may be fixed to the pump mount surface 172 of the cam bearing cap 120. The secondary oil pump 122 may receive oil from the primary oil pump via the pump inlet passage 166 from the first oil supply passage 136 and may further pressurize the oil. The oil pressurized by the secondary oil pump 122 may be provided to the OCVs 128, 130 via the second and third oil supply passages 138, 140. The OCVs 128, 130 may selectively provide the oil flow to the cam phasers 24, 26 via the first, second, third and fourth cam phaser feed passages 142, 144, 146, 148, the first and second advance passages 176, 178 and the first and second retard passages 180, 182.

The cam bearing cap 120 may additionally include a lubrication flow path 200 in communication with the pump outlet passage 170. The lubrication flow path 200 may include a recess 202 in the engine mount surface 174 of the cam bearing cap 120. The pump outlet passage 170 may extend through the recess 202. The lubrication flow path 200 may additionally include passages 204, 206 extending from the recess 202 and intersecting bolt holes 208 and ultimately oil grooves 210, 212. During engine operation, the oil supplied to the oil pump outlet passage 170 may be in communication with the oil grooves 210, 212 via the passages 204, 206 to form a lubricated bearing for the intake and exhaust camshafts 14, 16. The oil may flow through annular clearances around bolts securing the cam bearing cap 120 to the cylinder head 112.

The terms "first", "second", etc. are used throughout the description for clarity only and are not intended to limit similar terms in the claims.

What is claimed is:

1. An engine assembly comprising:

a cylinder head including first and second oil supply passages, the first oil supply passage being in communication with pressurized oil from a primary oil pump;

a first camshaft rotationally supported on the cylinder head;

a cam bearing cap including a first bearing cap region extending over the first camshaft and a pump mounting region extending from the first bearing cap region and defining an oil inlet and an oil outlet, the oil inlet being in communication with the first oil supply passage and the oil outlet being in communication with the second oil supply passage;

a hydraulically actuated engine component in communication with the second oil supply passage; and a secondary oil pump mounted to the pump mounting region and receiving the pressurized oil from the primary oil pump through the oil inlet and pumping the oil through the oil outlet to the hydraulically actuated engine component via the second oil supply passage.

2. The engine assembly of claim 1, wherein the pump mounting region includes an engine mount surface extending over the cylinder head and a pump mount surface having the secondary oil pump fixed thereto, the oil inlet and oil outlet extending through the engine mount surface and the pump mount surface and being in direct communication with the first and second oil supply passages in the cylinder head and the secondary oil pump.

3. The engine assembly of claim 2, wherein the engine mount surface abuts the cylinder head.

4. The engine assembly of claim 1, further comprising an oil control valve in fluid communication with the second oil supply passage, the hydraulically actuated engine component including a cam phaser and the cylinder head defining first and second cam phaser supply passages in communication with the oil control valve and the cam phaser.

5. The engine assembly of claim 4, wherein the cam bearing cap includes a third cam phaser supply passage in direct communication with the first cam phaser supply passage and a fourth cam phaser supply passage in direct communication with the second cam phaser supply passage.

6. The engine assembly of claim 5, wherein the pump mounting region includes an engine mount surface extending over the cylinder head and having the third and fourth cam phaser supply passages located therein, the third and fourth cam phaser supply passages extending from the engine mount surface to the first bearing cap region.

7. The engine assembly of claim 6, wherein the first bearing cap region includes first and second oil grooves axially spaced from one another, the third cam phaser supply passage including the first oil groove and the fourth cam phaser supply passage including the second oil groove, the first and second oil grooves providing pressurized oil from the secondary oil pump to the cam phaser.

8. The engine assembly of claim 7, wherein the cam bearing cap includes a lubrication passage in communication with the oil outlet.

9. The engine assembly of claim 1, wherein the hydraulically actuated engine component includes a valve lift assembly.

10. The engine assembly of claim 1, further comprising a second camshaft rotationally supported on the cylinder head, the cam bearing cap including a second bearing cap region extending over the second camshaft and the pump mounting region extending between and coupling the first and second bearing cap regions to one another.

11. The engine assembly of claim 1, wherein the cam bearing cap is a monolithic member.

12. An engine assembly comprising:

a cylinder head including first and second oil supply passages, the first oil supply passage being in communication with pressurized oil from a primary oil pump;

first and second camshafts rotationally supported on the cylinder head;

a cam bearing cap including a first bearing cap region extending over the first camshaft, a second bearing cap region extending over the second camshaft and a pump mounting region extending between the first and second bearing cap regions and defining an oil inlet and an oil outlet, the oil inlet being in direct communication with the first oil supply passage and the oil outlet being in direct communication with the second oil supply passage;

a cam phaser coupled to the first camshaft and in communication with the second oil supply passage; and a secondary oil pump mounted to the pump mounting region and in direct communication with the oil inlet and the oil outlet to provide further pressurized oil to the cam phaser via the second oil supply passage.

13. A cam bearing cap comprising:

a first bearing cap region adapted to extend over and secure a first camshaft to an engine cylinder head;

a pump mounting region extending from the first bearing cap region and adapted to have a secondary oil pump mounted thereto;

an oil inlet extending through the pump mounting region and adapted to provide communication between the secondary oil pump and an oil supply; and an oil outlet extending through the pump mounting region and adapted to provide communication between the secondary oil pump and a hydraulically actuated engine component.

14. The cam bearing cap of claim 13, wherein the pump mounting region includes an engine mount surface adapted to extend over the cylinder head and a pump mount surface adapted to have the secondary oil pump fixed thereto, the oil inlet and oil outlet extending through the engine mount surface and the pump mount surface and adapted to be in direct communication with the oil supply and the secondary oil pump.

15. The cam bearing cap of claim 13, wherein the pump mounting region includes an engine mount surface adapted to extend over the cylinder head and having first and second hydraulic component supply passages located therein and extending from the engine mount surface to the first bearing cap region.

16. The cam bearing cap of claim 15, wherein the first bearing cap region includes first and second oil grooves axially spaced from one another, the first hydraulic component supply passage including the first oil groove and the second hydraulic component supply passage including the second oil groove, the first and second oil grooves adapted to provide pressurized oil from the secondary oil pump to the hydraulically actuated engine component.

17. The cam bearing cap of claim 16, wherein the cam bearing cap includes a lubrication passage in communication with the oil inlet.

18. The cam bearing cap of claim 17, wherein the lubrication passage extends from the oil inlet to the first bearing region and includes a third groove axially spaced from the first and second grooves.

19. The cam bearing cap of claim 13, further comprising a second bearing cap region adapted to extend over a second camshaft, the pump mounting region extending between and coupling the first and second bearing cap regions to one another.

20. The cam bearing cap of claim 13, wherein the cam bearing cap is a monolithic member.

* * * * *